US011332348B2

(12) United States Patent
Peippo et al.

(10) Patent No.: US 11,332,348 B2
(45) Date of Patent: May 17, 2022

(54) SPLICE JOINT OF CRANE MAIN GIRDER

(71) Applicant: KONECRANES GLOBAL CORPORATION, Hyvinkää (FI)

(72) Inventors: Juha Peippo, Hyvinkää (FI); Kirsi Kalliokoski, Hyvinkää (FI)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 0 days.

(21) Appl. No.: 17/046,652

(22) PCT Filed: Apr. 12, 2019

(86) PCT No.: PCT/FI2019/050299
§ 371 (c)(1),
(2) Date: Oct. 9, 2020

(87) PCT Pub. No.: WO2019/202209
PCT Pub. Date: Oct. 24, 2019

(65) Prior Publication Data

US 2021/0163269 A1 Jun. 3, 2021

(30) Foreign Application Priority Data

Apr. 20, 2018 (FI) ..... 20185375

(51) Int. Cl.
*B66C 6/00* (2006.01)
*E04B 1/24* (2006.01)
(Continued)

(52) U.S. Cl.
CPC ..... *B66C 6/00* (2013.01); *E04B 1/2403* (2013.01); *E04B 2001/2409* (2013.01);
(Continued)

(58) Field of Classification Search
CPC . B66C 6/00; B66C 7/14; E04B 1/2403; E04B 2001/2409; E04B 2001/2457;
(Continued)

(56) References Cited

U.S. PATENT DOCUMENTS 2,456,055 A * 12/1948 Farrar ..... E04B 1/2403 403/230
4,499,697 A * 2/1985 LaLonde ..... E04B 9/122 52/506.07
(Continued)

FOREIGN PATENT DOCUMENTS

CN 1169764 A 1/1998
CN 1200782 A 12/1998
(Continued)

OTHER PUBLICATIONS

International Preliminary Report on Patentability for PCT/FI2019/050299 dated Aug. 24, 2020.
(Continued)

*Primary Examiner* — Rodney Mintz
(74) *Attorney, Agent, or Firm* — Birch, Stewart, Kolasch & Birch, LLP

(57) ABSTRACT

A splice joint of a main girder of a crane, the main girder including at least two longitudinal main girder parts to be connected to each other by their ends and each having a central web which includes at least one web plate, longitudinal upper and lower flanges, the lower flange protruding from the central web to both sides thereof. The splice joint includes a plate-like tongue-and-groove joint, the tongue-and-groove joint including a tongue fixed to the central web of a main girder part, and a groove fixed to the central web of a second main girder part; and a lower flange joint receiving the bending forces of the splice joint. The tongue-and-groove joints are arranged reversed in relation to each
(Continued)

other, and the location of the tongues and grooves on opposite sides of the web is reverse in relation to each other.

14 Claims, 4 Drawing Sheets

(51) Int. Cl.
*E04C 3/06* (2006.01)
*E04C 3/04* (2006.01)

(52) U.S. Cl.
CPC ..... *E04B 2001/2457* (2013.01); *E04C 3/06* (2013.01); *E04C 2003/0417* (2013.01); *E04C 2003/0452* (2013.01)

(58) Field of Classification Search
CPC ..... E04C 3/06; E04C 2003/0417; E04C 2003/0452; E04C 2003/0434
See application file for complete search history.

(56) References Cited

U.S. PATENT DOCUMENTS

| | | | | |
|---|---|---|---|---|
| 5,680,738 | A | 10/1997 | Allen et al. | |
| 7,607,273 | B2 * | 10/2009 | Henderson | E04B 1/2403 403/313 |
| 7,997,207 | B2 * | 8/2011 | Hess | B66C 7/14 104/95 |
| 8,035,032 | B2 * | 10/2011 | Jordan | H02G 3/0608 174/135 |
| 8,171,856 | B1 | 5/2012 | Arnal et al. | |
| 8,739,491 | B2 * | 6/2014 | Maisch | E04C 3/09 52/588.1 |
| 10,273,677 | B2 * | 4/2019 | Green | F16B 7/042 |
| 10,711,450 | B2 * | 7/2020 | Green | E04B 1/2403 |
| 10,900,215 | B1 * | 1/2021 | Alrubaidi | E04B 1/2403 |
| 2008/0060876 | A1 * | 3/2008 | Henderson | E04B 1/2403 182/186.8 |
| 2009/0159312 | A1 * | 6/2009 | Jordan | H02G 3/0608 174/135 |
| 2010/0019055 | A1 | 1/2010 | Hess | |
| 2012/0240508 | A1 * | 9/2012 | Maisch | E04C 3/086 52/588.1 |
| 2014/0083042 | A1 * | 3/2014 | Hiragaki | F16B 7/182 52/655.1 |
| 2016/0002910 | A1 * | 1/2016 | Green | F16B 7/182 52/848 |
| 2019/0257071 | A1 * | 8/2019 | Green | E04B 1/2403 |
| 2021/0114845 | A1 * | 4/2021 | Peippo | B23K 33/00 |

FOREIGN PATENT DOCUMENTS

| | | | | |
|---|---|---|---|---|
| CN | 201560055 | U | | 8/2010 |
| CN | 201610348 | U | | 10/2010 |
| CN | 105236276 | A | | 1/2016 |
| CN | 105473492 | A | | 4/2016 |
| CN | 110318467 | A | * | 10/2019 |
| DE | 197 04 019 | A1 | | 12/1997 |
| GB | 1159560 | A | | 7/1969 |
| JP | 6-81312 | A | | 3/1994 |
| SU | 617352 | A | | 7/1978 |
| WO | WO 2008/020716 | A1 | | 2/2008 |

OTHER PUBLICATIONS

International Search Report for PCT/FI2019/050299 dated Jul. 19, 2019.
Written Opinion of the International Searching Authority for PCT/FI2019/050299 dated Jul. 19, 2019.

* cited by examiner

SPLICE JOINT OF CRANE MAIN GIRDER

BACKGROUND OF THE INVENTION

The invention relates to a splice joint of a main girder of a crane, whereby the main girder comprises at least two longitudinal main girder parts to be connected to each other by their ends and both having a central web which comprises at least one web plate, a longitudinal upper flange or top plate arranged to the top part of the central web as well as a longitudinal lower flange which is arranged to the bottom part of the central web and which protrudes from the central web to its both sides.

Conventionally, the splice joint of a main girder has been implemented either by welding together the main girder parts at the ends that face each other, or as a flange joint or a strapped joint of these ends. The number of joining elements is often high, which causes a challenge for an economical implementation of the joint.

In a flange joint, the ends of the main girder parts to be joined together are provided with suitably sturdy transverse end plates by which these ends are then joined together with bolts. To ensure the functioning of the bolts in such a joint, the thickness of the flanges is typically large. All the forces are borne by the normal force/pretension of the bolts. Welding the thick end flanges may additionally require preheating. A force transverse in relation to the direction of rolling the end plates may result in z plate requirement (lamellar tearing) and said need for preheating. Welding end plates to profile-like or casing-like main girder parts causes a large local heat input which may result in deformations that have to be compensated for by machining.

A strapped joint is implemented by junction plates that are fixed on both sides of the central webs of the main girder parts as well as to the lower and upper flanges. The bolts in the webs convey the shear force, and the bolts in the flanges the bending moment. This solution has plenty of joining elements (bolts) and a lot of holes to align, which need to be in their correct place. Aligning the ends of the main girder parts so that the holes line up is a demanding procedure. The traditional experience is that a strapped plate joint is arduous to manufacture and install, and expensive cost-wise.

SUMMARY OF THE INVENTION

It is an object of the invention to achieve a new type of splice joint so that the aforementioned problems may be solved. This object is reached by the inventive splice joint which is characterised in that the splice joint comprises, on both outer sides of the central web, a plate-like tongue-and-groove joint receiving the shear forces of the splice joint, the tongue-and-groove joint in each case comprising a tongue fixed to the central web of a main girder part to be joined, and a groove fixed to the central web of a second main girder part to be joined; and a lower flange joint receiving the bending forces of the splice joint, whereby the tongue-and-groove joints on opposite outer sides of the web are arranged reversed in relation to each other, and whereby the location of the tongues and grooves on opposite sides of the web is reverse in relation to each other.

When the tongues and grooves are mutually on opposite sides reversed in relation to each other the advantage is achieved where a later opening and assembly of a spliced joint is simpler than if, for example, the tongues were in parallel on the joining area at an opened end of the same main girder part. In practise, the ends of the main girder parts in such a case orient themselves into place more easily.

Preferred embodiments of the invention are disclosed in the dependent claims.

The present invention achieves the following advantages, for example:

The tolerances of the parts forming the tongue-and-groove joint may be taken into account in connection with their manufacture. This tongue-and-groove construction also allows that its position in the joint is not restricted to one defined position. When the parts for the tongue-and-groove joint are advantageously made by flame cutting, it is easy to establish an optimum shape for them, guaranteeing the absence of play in the joint without expensive machining. The shear force that the central web is subject to is conveyed across the joint without additional joining elements. When the tongues and grooves of the tongue-and-groove joint have been attached in place (in the manner described below), their shaping guides the main girder parts to be joined together precisely in their correct positions. This is particularly important when the final assembly of the main girder takes place at the customer. The joint is also fast to assemble for the above reasons.

When a coupling plate placed under the lower flange is used in the lower flange joint, a structure may be achieved by positioning its fastening bolts, in which the lower flange, used as the running surface of the wheels of a trolley, may be made smooth enough without expensive machining.

The joint according to the invention has no major heat input centres because heat is only needed for fastening the parts of the tongue-and-groove joint, if it is done by welding. When a casing-like central web is used, there is no need to make openings of any kind in it for tightening the joining bolts. All the parts needed for the joint may be manufactured by common manufacturing technologies normally used by workshops, such as flame cutting by a laser or plasma torch. This also minimises the work phases. Furthermore, there is no need to work inside the main girder since the work stages and targets are on the outside.

LIST OF FIGURES

The invention will now be explained in more detail with reference to the accompanying drawings, in which FIG. 1 is a perspective view of the inventive splice joint on a main girder of a crane before the final joining of the joint;

DETAILED DESCRIPTION OF THE INVENTION

Figure 1:
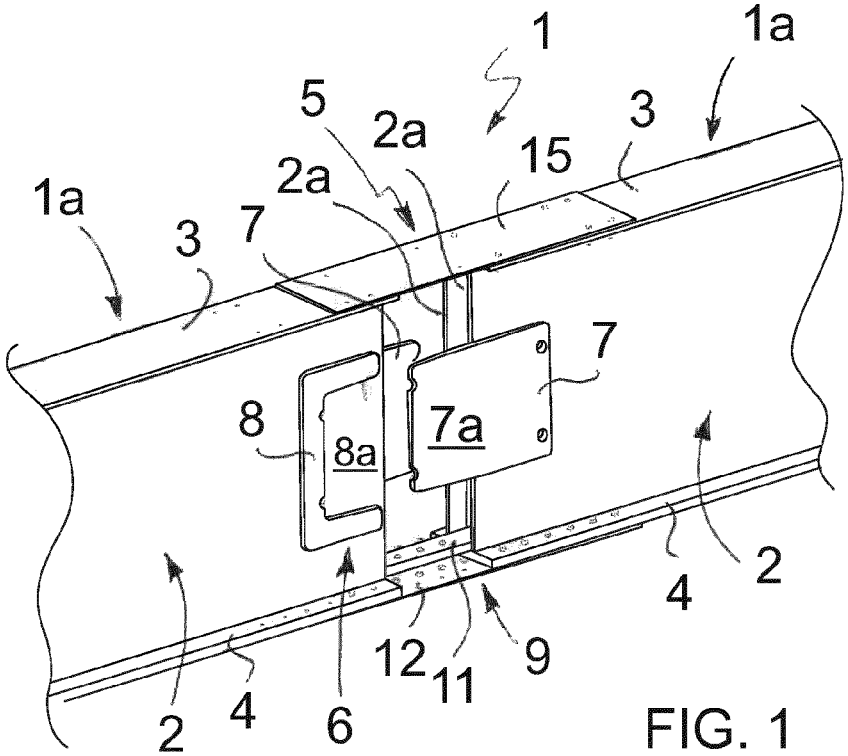

Referring to the drawings, a crane main girder 1 is shown, having at least two longitudinal main girder parts 1*a* to be joined together by their ends. Each main girder part 1*a* has a central web 2 which comprises at least one web plate, in this exemplary case two web plates 2*a* at a distance from each other. To the top part of the central web 2, a longitudinal upper flange 3 has been fastened, protruding from the central web 2 on its both sides. Correspondingly on the bottom part of the central web 2, a longitudinal lower flange 4 has been fastened, likewise protruding from the central web 2 on its both sides. The edges of this lower flange 4 typically act as the support and running guide of a trolley (not shown). The dimensioning of the lower flange 4 takes into account that the wheels of a trolley adapted to run on the lower flange 4 are able to pass the bolt joints adapted to the lower flange 4. The ends of the main girder parts 1*a* may be flame cut without the finishing following the flame cutting.

Between the main girder parts 1*a*, a splice joint 5 of the crane main girder 1 is arranged, which on the one hand comprises, on both outer sides of the central web 2, a plate-like tongue-and-groove joint 6 receiving the shear forces of the splice joint 5, whereby this tongue-and-groove joint 6 in each case comprises a tongue 7 fixed to the central web of a main girder part 1*a* to be joined, and a groove 8 fixed to the central web 2 of a second main girder part 1*a* to be joined; and, on the other hand, a lower flange joint 9 receiving the bending forces of the splice joint 5. The splice joint 5 is here presented in connection with the main girder 1, but it may also be made in connection with a main girder comprising one web plate (I beam).

The tongue-and-groove joints 6 on the opposite outer sides of the web 2 are advantageously arranged reversely in relation to each other, where by the position of the tongues and grooves 7, 8 on the opposite sides of the web is reverse in relation to each other. This means that all the main girder parts 1*a* to be joined may be made the same, but turn them the other way round as the splice joint 5 is being made. The tongues and grooves 7, 8 on two different sides of the main girder 1 are made as their own mutual pairs when they are detached from the plate material.

The groove 8 has a recess cutout 8*a* of almost rectangular shape, and the tongue 7 has a coupling area 7*a* whose shape matches the recess cutout 8*a* and fits the cutout recess 8*a* with a predefined adaptor.

In the most advantageous case, the groove 8 has a recess cutout 8*a* substantially widening towards the tongue 7, and the tongue 7 has a coupling area 7*a* whose shape corresponds to the recess cutout 8*a* and fits the recess cutout 8*a* with a predefined adaptor. The solution shown by the figures has such a slightly widening recess cutout 8*a* and a slightly narrowing coupling area 7*a*. The tongue-and-groove joints may have a trapezoidal form as seen from the side, whose longitudinal centre line is in the direction of the longitudinal axis of the main girder 1. The shape of the tongue-and-groove joints 6 is not, however, solely restricted to these examples. The essential thing is that the main girder pars 1*a* may be easily connected to each other while the tongue-groove pair 7, 8 of the tongue-and-groove joint 6 receives the shear forces of the joint 5 as planned.

Figure 6:
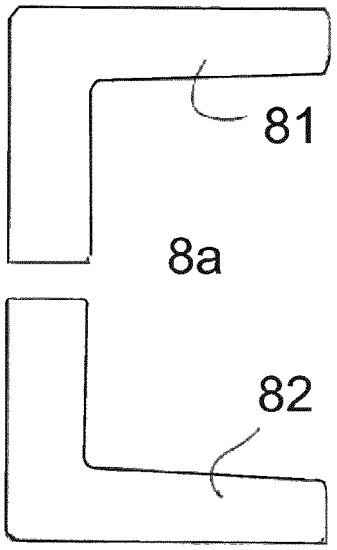
FIG. 6 shows an alternative implementation for the groove of a tongue-and groove joint.

The groove 8 now disclosed is one-piece, but it may, as shown in FIG. 6, also comprise two parts 81 and 82 which together form the recess cutout 8*a*. This allows the groove-and-tongue joint 6 to be diversely adjusted from the viewpoint of the requirements of the adaptor and installation.

The tongues and grooves 7, 8 of each tongue-and-groove joint 6 are advantageously pieces flame cut in one go from the same plate material, by the beamcut method, for example. This allows the creation of a dimensionally accurate joint pair in which a natural fit is formed. The gap, having the width of the cutting beam and created during the cutting process, may be compensated for by choosing a suitable angle for the horizontal contact points between the recess cutout 8*a* of the groove 8 and the coupling area 7*a* of the tongue 7, that is, the widening of the groove 8 and narrowing of the tongue 7 referred to in the above. The tongues and grooves 7, 8 of the tongue-and-groove joint 6 are fastened to the central web 2 by welding, the performing of which (point in time of fastening) is described below. In a completed joint, the tongues and grooves 7, 8 are advantageously secured to each other by fastening bolts 10 at their boundary surfaces.

To receive said shear forces as well as pulling force of the splice joint 5, the lower flange joint 9 comprises a first coupling plate 11 arranged in the space between the web plates 2*a* of the central web 2, and a second coupling plate 12 arranged under the lower flange 4 and extending substantially on the width of the lower flange 4, whereby the coupling plates 11, 12 are fastened to both main girder parts 1*a* to be joined by fastening bolts 13, 14 below the second coupling plate 12, the fastening bolts 14 of the second coupling plate 12 fastening to flange parts 4*a* protruding to the sides of the lower flange 4. If the second coupling plate 12 is thick enough and/or the space between the web plates 2*a* is small, the first coupling plate 11 may be left out. However, the first coupling plate 11 is advantageous, because it supports the splice joint 5 in the transverse direction.

Figure 5:
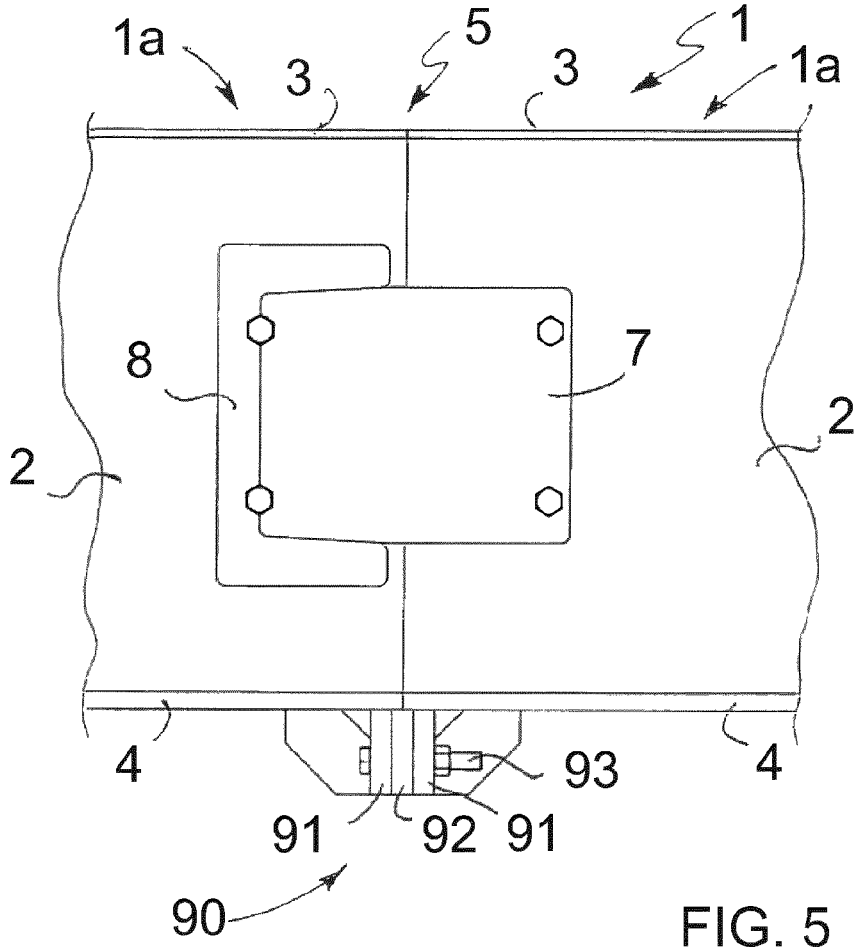
FIG. 5 is a side view of an alternative splice joint on a main girder of a crane in its completed form.

FIG. 5 shows an alternative lower flange joint 90 which comprises lugs 91 arranged on the bottom surface of the lower flange 4 of both main girder parts 1*a* to be joined, intermediate piece arrangements 92 to be placed between opposite lugs 91, and fastening bolts 93 passing through the lugs 91 and intermediate piece arrangements 92.

Figure 2:
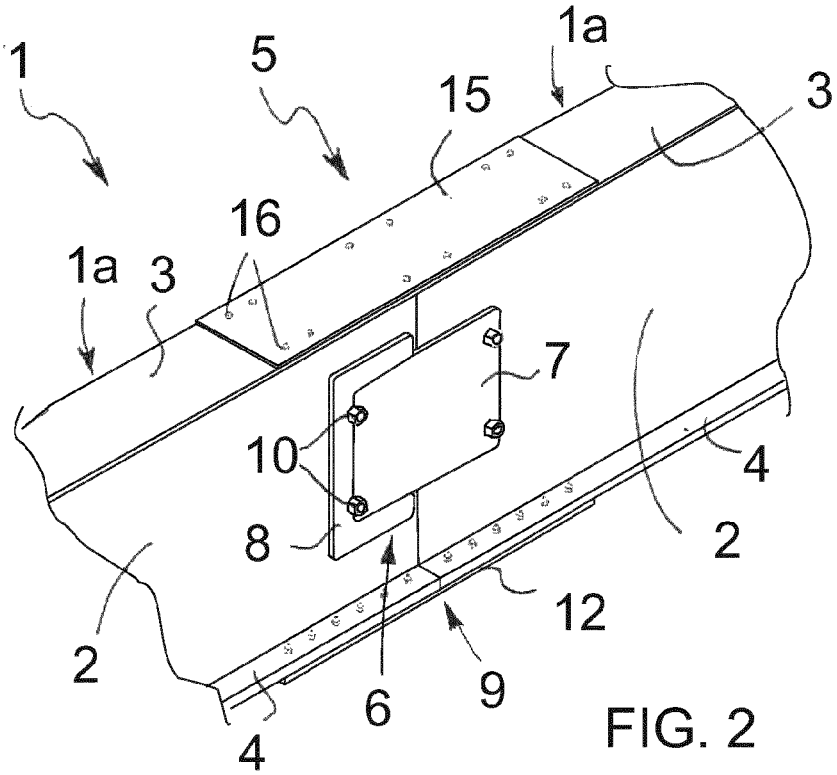
FIG. 2 is a perspective view of a joint according to FIG. 1 in its completed form.
Figure 3:
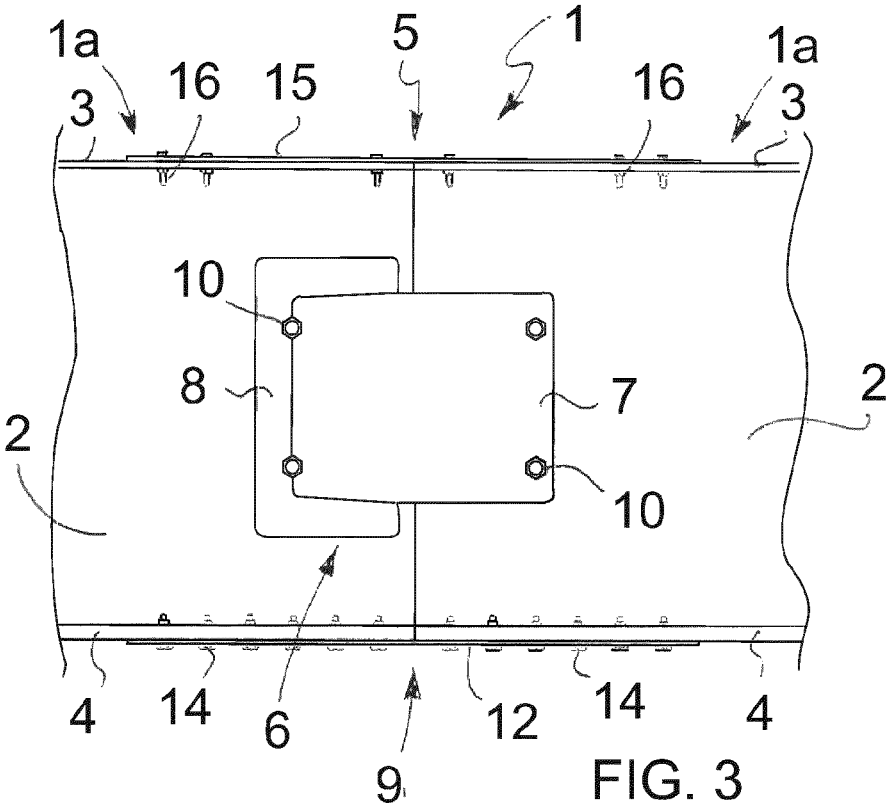
FIG. 3 is a side view of the completed joint of FIG. 2.
Figure 4:
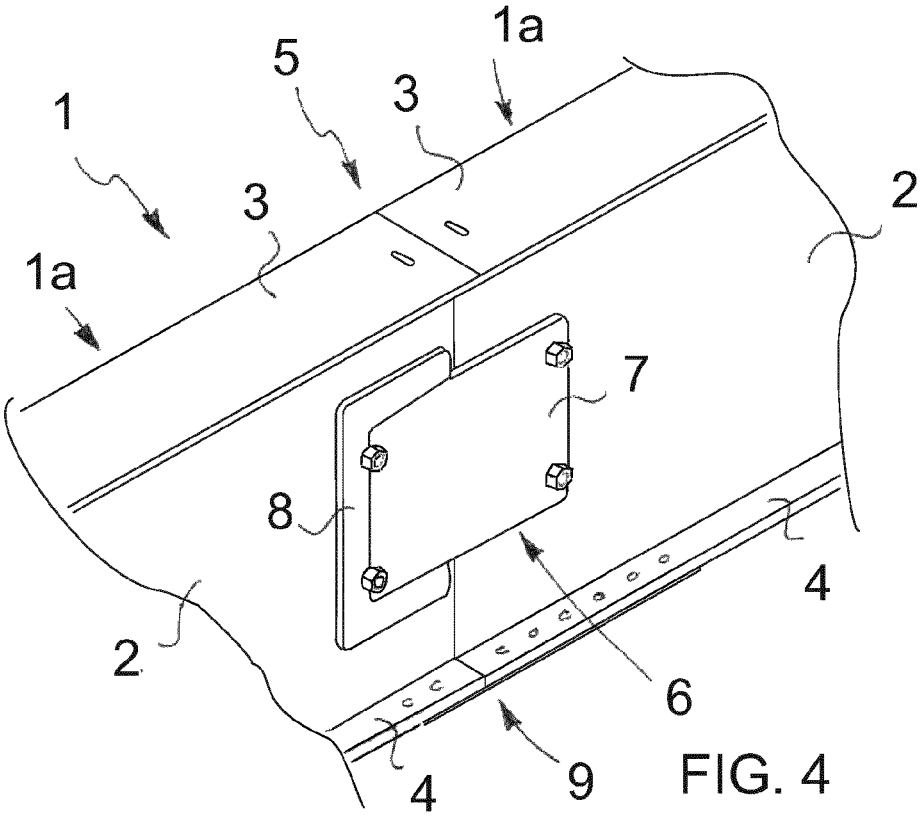
FIG. 4 is a perspective view of the joint according to the previous figures without the coupling plate of the upper flanges.

The inventive splice joint 5 may further comprise a third coupling plate 15 arranged over the upper flange 3, which is fastened to both the main girder parts 1*a* to be joined by fastening bolts 16 above the third coupling plate 15 (FIGS. 1 to 3).

The compression force of the splice joint 5 is carried on the contact area of the upper flange 3 and central web 2, and the possible third coupling plate 15.

In the splice joint 5 between the main girder parts 1*a* there may be an end-to-end gap so that only the bottom edge of the splice joint 5 has a butt joint, otherwise the splice joint 5 may open upwards as a narrow V slot as seen from the side. The advantage is that on adapter surfaces of a high main girder 1 (height e.g. 400 mm or more), only the bottom edge has a precise contact, the other surfaces are left without a need for an exact fitting requirement, and this being the case they need not be machined, polished, or otherwise adapted more precisely to each other. Due to the end-to-end gap, a pre-raising or pre-curvature may be made, which can later be adjusted or corrected. The holes of the bolts passing through the central web 2 have, as concerns clearance holes, a suitable amount of play. In end-to-end gaps, the forces of the girder are carried so that the coupling plate 11, 12 added to the lower flange 4 carries the pulling portion. The coupling plate 15 placed in the upper flange 3 carries compression. The tongue and groove plates 7, 8 on the sides of the web plates 2*a* carry the shear force. The coupling plate 15 in the upper flange 3 is assembled with a bolt and nut screw joint so that there are clearance holes through the upper flange 3, which have enough play to facilitate installation and to set a suitable pre-raising, if needed.

The assembly force and direction of the splice joint 5 is mainly axial. Assembly is planned to take place on a mainly planar surface on a horizontal plane from which it is the most natural way to carry out the assembly axially by bolts, the shaping of the tongues and grooves 7, 8 allowing fitting beside each other in the axial direction, in other words, the male and female surfaces, as to their longitudinal sides, of the tongues and grooves 7, 8 placed in a butt joint are so formed that the axial setting is possible by a linear motion. The splice joint 5 is at substantially half way the longitudinal direction of the main girder 1, if the main girder 1 is assembled of two parts (the main girder may be put together of more than two main girder parts). There may be a plurality of main girders 1 in parallel. The main girder 1 is suited to be supported by the ends as the supporting main girder 1 without intermediate supports between the ends.

Figure 7A:
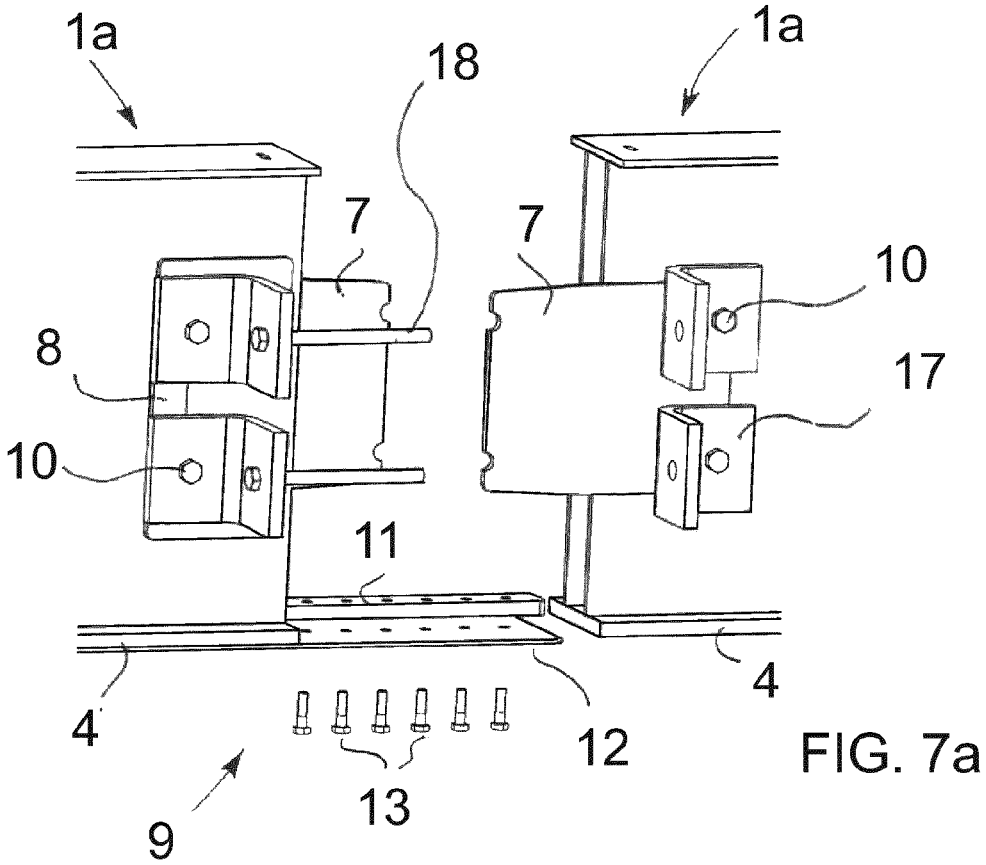
FIGS. 7*a* and 7*b* show work stages of forming the inventive splice joint and the accessories used in the work.
Figure 7B:
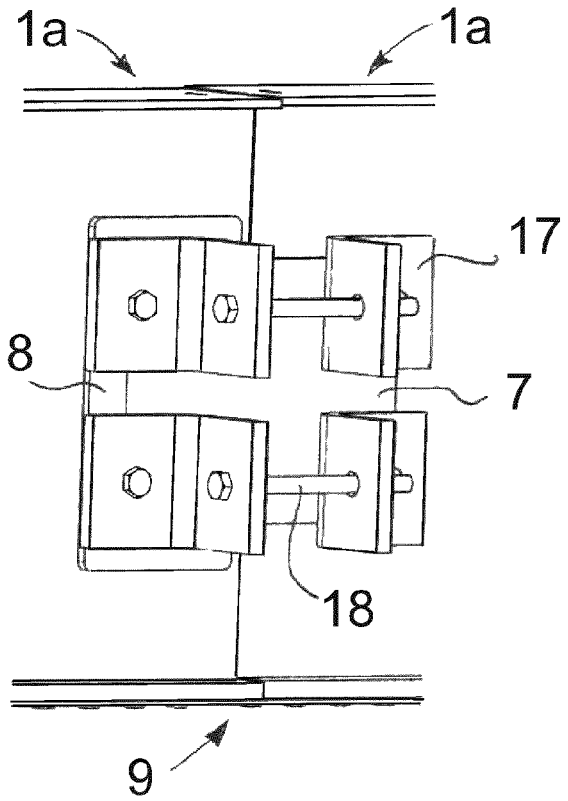

Referring to FIGS. 7*a* and 7*b*, the inventive splice joint 5 which is according to FIGS. 1 to 4 is implemented as follows:

The first coupling plate 11 (possible) and second coupling plate 12 of the lower flange joint 9 are fixed by fastening bolts 13, 14 to one main girder part 1*a*. The main girder parts 1*a* are brought tightly against each other, after which the tongues and grooves 7, 8 and L-shaped installation instruments 17 possibly placed on top of them are fastened on both sides of the splice joint 5 by fastening bolts 10 to the central webs 2. Following this, the tongues and grooves 7, 8 are welded by their edges to the central webs 2. The tongues and grooves 7, 8 are welded to the central web 2 but are not advantageously mutually connected by welding. So, the splice joint 5 is advantageously possible to assemble and disassemble by means of the bolt joints. The L-shaped fastening instruments are provided with holes for the fastening bolts 18 with which the prefabricated splice joint 5 (tongues and grooves 7, 8) may later on be tightened in place, if the main girder parts 1*a* are separated from each other after welding and the splice joint 5 is not completed there and then. If the splice joint 5 is not completed straight away, it is not necessary to prepare the lower flange joint 9, either, in the manner described in the above, if the ends of the main girder parts 1*a* can be made to stay tightly together as the tongues and grooves 7, 8 are being installed.

If the splice joint 5 is now completed in one go, installation instruments 17 are not necessarily needed, whereby the splice joint 5 is finished by fastening the first and second coupling plate 11, 12 to the second main girder part 1*a* and by additionally installing the possible third coupling plate 15 over the upper flanges 3. Additionally, in particular if the splice joint 5 is finished in one go, the tongues and grooves 7, 8 may be fastened in other ways, too, to the central web for welding. If, however, the aforementioned fastening bolts 10 are used in the fastening of the tongues and grooves 7, 8 for welding and installation instruments 17, they may in particular be used for coupling the tongues and grooves 7, 8 to each other after the fastening instruments 17 have been removed. This coupling may be seen in the figures in such places where the vertical coupling surfaces of the tongues and grooves 7, 8 connect to each other. As shown in FIG. 7, it may be noted that the front edge of the tongues 7 on the splice joint 5 side fits in the vertical gap when the installation instruments 17 are used when the splice joint 5 is pulled together by using fastening bolts 18. The vertical gap in this case is the gap between the installation instruments 17 and the main girder 1. The thickness of the vertical gap is substantially the same as the material thickness used for the tongues and grooves 7, 8. Along with the adequate thickness of the tongues and grooves 7, 8, the fastening bolts 10 also allow the compensation of potential deformations of the splice joint 5 during, for example, welding the tongues and grooves 7, 8. By utilizing the fastening bolts 18, the main girder parts 1*a* can be made to controllably approach each other without, for example, the need to push the heavy main girder parts 1*a* on the assembly platform by forklifts or similar. In addition, an installer simultaneously sees the completion of the splice joint 5 and may in the same working position increase the force of the fastening bolts 18. This facilitates making the splice joint and reduces the need for mutual coordination among workers. Furthermore, the welding work and final inspection may be avoided in the installation conditions, because the tongues and grooves 7, 8 may have been welded to each main girder part 1*a* by the manufacturing and inspection equipment at the workshop. As a result of what is described in the above, there is no need to set any high requirement for the assembly platform that the matching requires.

The implementation of the splice joint 5 of FIG. 5 differs from the implementation of the splice joint in FIGS. 1 to 4 only as concerns the making of the lower flange joint 90. There, the lower flange joint 90 need not be considered in the same way as the lower flange joint 90 according to FIGS. 1 to 4, but it may possibly be utilized during the fastening of the tongues and grooves 7, 8.

The above description of the invention is only intended to illustrate the basic idea of the invention. The invention and its embodiments are therefore not restricted to the above examples but a person skilled in the art may implement the details of the invention within the scope of the attached claims.

The invention claimed is:

1. A system comprising:

a main girder of a crane, comprising at least two longitudinal main girder parts to be connected to each other by ends thereof, each of the at least two longitudinal main girder parts having a central web which comprises at least one web plate, a longitudinal upper flange or top plate arranged to a top part of the central web and a longitudinal lower flange arranged to a bottom part of the central web, the longitudinal lower flange protruding from the central web to both sides thereof, the main girder being configured to be supported by the ends without intermediate supports between the ends; and a splice joint configured to connect the at least two longitudinal main girder parts, wherein the splice joint comprises:

on both outer sides of the central web, a tongue-and-groove joint formed from a plate material, the tongue-and-groove joint receiving shear forces of the splice joint, the tongue-and-groove joint in each case comprising a tongue fixed to the central web of a first main girder part of the at least two longitudinal main girder parts to be joined, and a C-shaped groove fixed to the central web of a second main girder part of the at least two longitudinal main girder parts to be joined; and a lower flange joint receiving bending forces of the splice joint, wherein the tongue-and-groove joints on opposite outer sides of the web are arranged reversed in relation to each other, and wherein the tongues and grooves are located on opposite sides of the web in reverse relation to each other, and wherein shapes of the tongues and grooves allow fitting beside each other in an axial direction, the longitudinal sides of the male and female surfaces of the tongues and grooves being positioned in a butt joint such that an axial setting is provided by a linear motion.

2. The system as claimed in claim 1, wherein the groove has a substantially rectangular recess cutout, and the tongue has a coupling area whose shape matches the recess cutout and fits the cutout recess with a predefined adaptor.

3. The system claimed in claim 1, wherein the groove has a recess cutout substantially widening towards the tongue, and the tongue has a coupling area whose shape corresponds to the recess cutout and fits the recess cutout with a predefined adaptor.

4. The system as claimed in claim 1, wherein the groove is one-piece.

5. The system as claimed in claim 1, wherein the groove comprises two parts which together form the recess cutout.

6. The system as claimed in claim 1, wherein the tongues and grooves of each tongue-and-groove joint are pieces flame cut from the same plate material.

7. The system as claimed in claim 1, wherein the tongue-and-groove joints are fastened to the central web by welding.

8. The system as claimed in claim 1, wherein the tongues and grooves are secured to each other by fastening bolts at boundary surfaces thereof.

9. The system as claimed in claim 1, wherein the central web comprises two web plates at a distance from each other, whereby the lower flange joint comprises a first coupling plate arranged in a space between the web plates, and a second coupling plate arranged under the lower flange and extending substantially on a width of the lower flange, whereby the coupling plates are fastened to both main girder parts to be joined by fastening bolts below the second coupling plate, the fastening bolts of the second coupling plate fastening to flange parts protruding to the sides of the lower flange.

10. The system as claimed in claim 1, wherein the lower flange joint comprises lugs arranged on a bottom surface of the lower flange of both main girder parts to be joined, intermediate piece arrangements to be placed between opposite lugs, and fastening bolts passing through the lugs and intermediate piece arrangements.

11. The system as claimed in claim 1, wherein the splice joint further comprises a third coupling plate arranged over the upper flange, which is fastened to both the main girder parts to be joined by fastening bolts above the third coupling plate.

12. The system as claimed in claim 1, wherein the splice joint is disassembled by opening the bolt joints.

13. The system as claimed in claim 1, wherein in the splice joint between the main girder parts there is an end-to-end gap so that only a bottom edge of the splice joint has the butt joint, or the splice joint opens upwards as a narrow V slot as seen from the side.

14. A crane main girder, comprising:

at least two longitudinal main girder parts to be connected to each other by ends thereof, each of the at least two longitudinal main girder parts having a central web which comprises at least one web plate, a longitudinal upper flange or top plate and a longitudinal lower flange; and a splice joint configured to connect the at least two longitudinal main girder parts, wherein the splice joint comprises:

on both outer sides of the central web, a tongue-and-groove joint formed from a plate material, the tongue-and-groove joint receiving shear forces of the splice joint, the tongue-and-groove joint in each case comprising a tongue fixed to the central web of a first main girder part of the at least two longitudinal main girder parts to be joined, and a C-shaped groove fixed to the central web of a second main girder part of the at least two longitudinal main girder parts to be joined; and a lower flange joint receiving bending forces of the splice joint, wherein the tongue-and-groove joints on opposite outer sides of the web are arranged reversed in relation to each other, and wherein the tongues and grooves are located on opposite sides of the web in reverse relation to each other, and wherein shapes of the tongues and grooves allow fitting beside each other in an axial direction, longitudinal sides of the male and female surfaces of the tongues and grooves being positioned in a butt joint such that an axial setting is provided by a linear motion.

* * * * *